US007045743B2

(12) United States Patent
Park

(10) Patent No.: US 7,045,743 B2
(45) Date of Patent: May 16, 2006

(54) HEATED VEHICLE CUSHION

(76) Inventor: Ki-Woong Park, 5314 Larochelle Dr., Alexandria, VA (US) 22315

( * ) Notice: Subject to any disclaimer, the term of this patent is extended or adjusted under 35 U.S.C. 154(b) by 0 days.

(21) Appl. No.: 10/756,498

(22) Filed: Jan. 14, 2004

(65) Prior Publication Data

US 2004/0195227 A1 Oct. 7, 2004

Related U.S. Application Data

(60) Provisional application No. 60/440,306, filed on Jan. 15, 2003.

(51) Int. Cl.
*H05B 1/00* (2006.01)

(52) U.S. Cl. ..... 219/217; 219/202; 219/528

(58) Field of Classification Search ..... 219/217, 219/528, 202, 543, 544; 297/180.12
See application file for complete search history.

(56) References Cited

U.S. PATENT DOCUMENTS 4,628,188 A * 12/1986 Andreasson ..... 219/528
5,516,189 A * 5/1996 Ligeras ..... 297/180.11
5,775,952 A * 7/1998 Lu ..... 439/668
6,073,998 A * 6/2000 Siarkowski et al. ... 297/180.12

FOREIGN PATENT DOCUMENTS

GB 2263396 A * 7/1993

* cited by examiner

*Primary Examiner*—Robin O. Evans
*Assistant Examiner*—Vinod Patel
(74) *Attorney, Agent, or Firm*—Young & Thompson

(57) ABSTRACT

Vehicle heating systems such as portable vehicle cushions, steering wheel covers, and other interior surfaces include a direct current heating circuit for producing heat when activated; a surface material covering the heating circuit to isolate the heating circuit from direct contact by a vehicle occupant or object resting against the surface material; and a pressure switch located below the surface material and connected to the heating circuit to activate the heating circuit during application of sufficient pressure on the pressure switch by a vehicle occupant resting against the surface material at a location proximate the pressure switch, insufficient pressure being applied to the pressure switch deactivating the heating circuit.

15 Claims, 6 Drawing Sheets

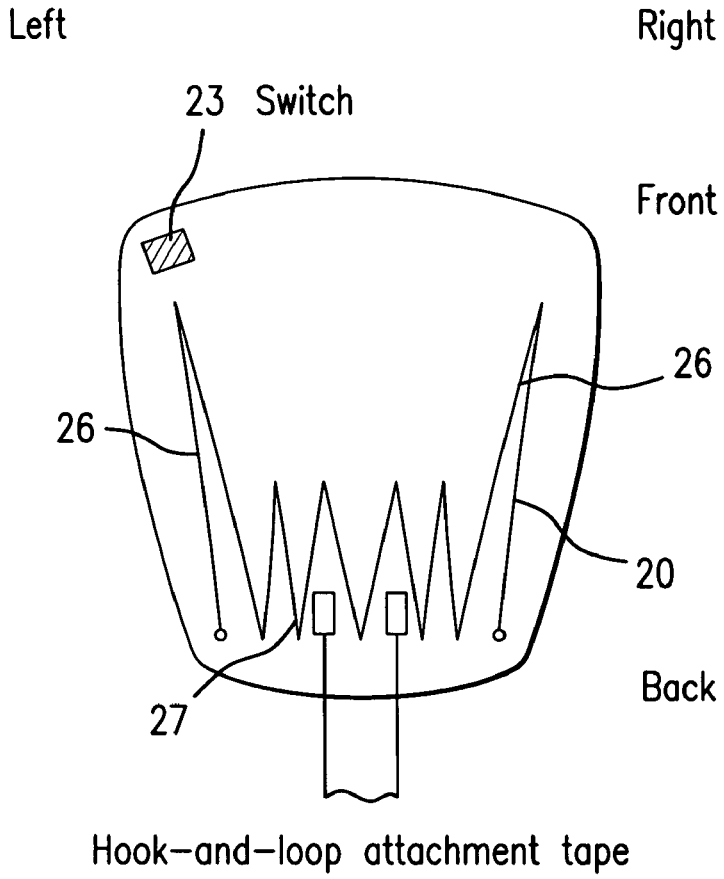
FIG.4
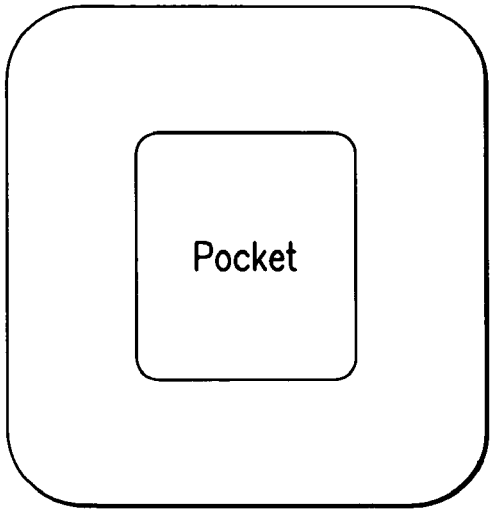

HEATED VEHICLE CUSHION

RELATED APPLICATIONS

This application claims priority to U.S. Provisional Application 60/440,306.

BACKGROUND OF THE INVENTION

The invention relates to heated vehicle cushions and surfaces. Preferred embodiments provide enhanced safety through pressure switch activation and visual indication of heating activation in portable heated vehicle cushions and surfaces.

DESCRIPTION OF THE RELATED ART

In cold weather, a vehicle's interior surfaces are cold when the vehicle is first started and for some time afterwards. The cold seats, steering wheel, and other surfaces cause discomfort to the driver and other vehicle occupants. This discomfort may prove distracting and impair the driver's ability to give her full attention to safely operating the vehicle.

Heated seats partly address this problem. Although heated seats are available in some high-end vehicles, heated seats are not inexpensive and are not widely available for all vehicles.

Further, these heated seats are activated by a console-mounted switch which the vehicle driver toggles to begin the seat heating. These switches may result in the seats being hot even when not occupied, and the heating not beginning until the occupant remembers to toggle the on/off switch. This may result in other safety problems and delay in heating the seating surface.

Additionally, heated seats are not transportable. Thus, each vehicle must have its own heated seat.

SUMMARY OF THE INVENTION

The present invention is generally directed to heated vehicle cushions and surfaces, e.g., a heated seating surface, safely activated (powered on) by a vehicle occupant applying pressure to a pressure activated switch, e.g., by applying weight to a seating surface or by applying pressure to a designated surface area.

The present invention is directed to heated vehicle seats including horizontal and vertical seating surfaces, to heated steering wheels, and other interior vehicle heated surfaces.

The invention can be applied both to factory equipped components and to after market components. After market components include portable heated seat cushions and heated steering wheel covers as well as other devices that include a cushioned area that responds to exerted pressure.

The portable heated seat cushion of the invention is transportable between vehicles, unlike factory-equipped heated vehicle seats with the heating elements built into the vehicle seat itself.

The portable heated seat cushion of the invention is more convenient to move from one vehicle to another since the heated cushion may only cover the horizontal seat portion of the vehicle seat, i.e., need not include a back portion.

The portable heated seat cushion of the invention is easily controlled and safe due to automatic control by setting a desired temperature and allowing on/off control (activation) by shifting position of an occupant's leg relative to a switch and through automatic reaction by a thermostat. Thus, the driver using the heated cushion need not divert her eyes off the road or make large movements when driving. Safety is enhanced through the use of a light indicator that readily alerts an occupant if current is flowing through the heated seat cushion. In some embodiments, the occupant may adjust the temperature setting.

The portable heated seat cushion is warm after a short heating time due to the nature and positioning of the heating element in the cushion, as well as the automatic activation based on the pressure of the occupant sitting on the seat cushion.

BRIEF DESCRIPTION OF THE DRAWINGS

FIGS. 2–4 illustrate a heated vehicle seat and heated vehicle seat cushion embodiment of the invention.

DESCRIPTION OF THE PREFERRED EMBODIMENTS

Figure 1:
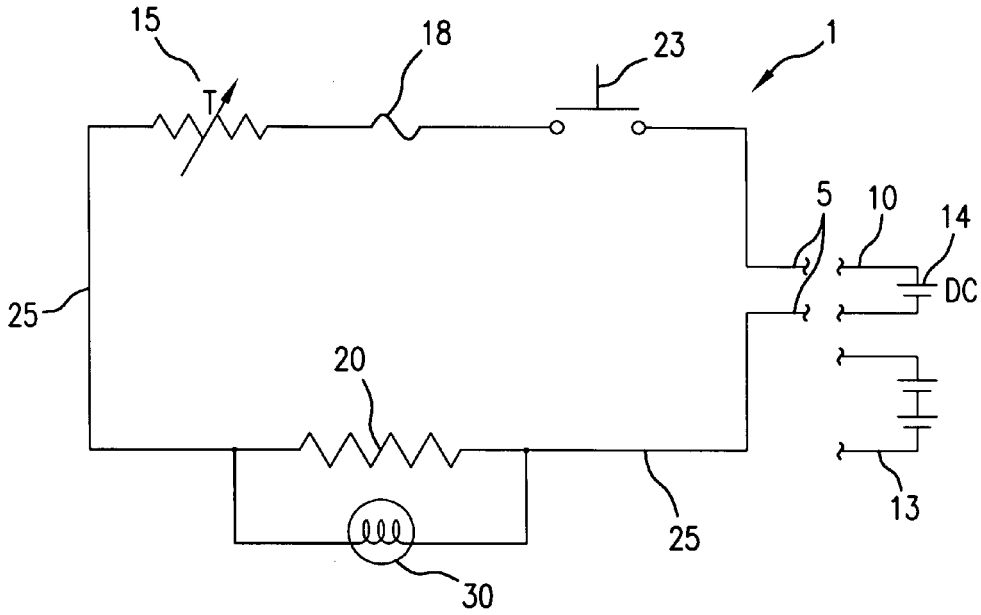
FIG. 1 is a schematic of an electric circuit which implements the invention.

With reference to FIG. 1, the inventive vehicle heating circuit (1) includes a power connector (5) for connection to a mating power source connector (10), a cyclic temperature control element (15), a heating element (20), a pressure activated power on/off switch (23), and connecting power cabling (25).

Advantageously, the heating circuit (1) may include a heating indicator (30) that illuminates when the heating element is active; that is, when power (current) is being provided to the heating element (20) and the heating element (20) is generating heat. The heating indicator (30) is shown as being in parallel with the heating element (20); however, other configurations may be provided.

Typically, the heating circuit (1) includes a fuse (18) to prevent overheating as well as protect against over current conditions such as short circuit.

Advantageously, the heating circuit (1) runs off the vehicle's normal direct current ("DC") power (14) provided via the power source connector (10). The mating power source connector (10), to which the power connector (5) connects, may be a wiring harness snap connector, a cigarette lighter style power receptacle, an accessory power receptacle, or any other convenient connector which permits DC power, e.g., the vehicle battery, to energize the vehicle heating circuit (1). In this way, the invention can be implemented as a factory equipped product and an after market product.

The heating circuit (1) may also be powered from an independent battery or battery pack (13). This makes the invention portable and useable outside a vehicle, such as at a stadium. Alternatives to electric heat are discussed below.

The heating element (20) is preferably a thermo-resistive element that produces heat when electricity flows through it. The heating element (20) is also preferably configured to be flat so as to reduce any protrusion of the heating element (20) through overlying materials and avoid any discomfort to the vehicle occupant sitting on or resting against the heating element (20).

The temperature control element (15) functions as a cyclic temperature-dependent power control element to provide temperature control and safe operation of the invention.

The temperature control element may be a thermostat, either preset or adjustable to allow the occupant to control the amount of heat produced by the heating element (20). When the heating element (20) reaches a desired set temperature, e.g., between 45° and 50° C., the thermostat opens the electrical circuit to disconnect power to the heating element (20) and stop further heating. When the temperature falls below the set temperature, the thermostat again closes the electrical circuit to reconnect power to the heating element (20) and resume heating.

Alternatively, the temperature control element (15) may be a variable resistive element set to control the amount of electrical power through the heating element (20). Other temperature control elements may be used to energize and de-energize the heating element (20) based on temperature.

The power switch (23) advantageously is activated (closed) by pressure, e.g., from the occupant's weight or pressing force. This ensures the heating circuit (1) is only active when appropriate; that is, when the occupant is in place relative to the heating circuit (1).

Figure 2:
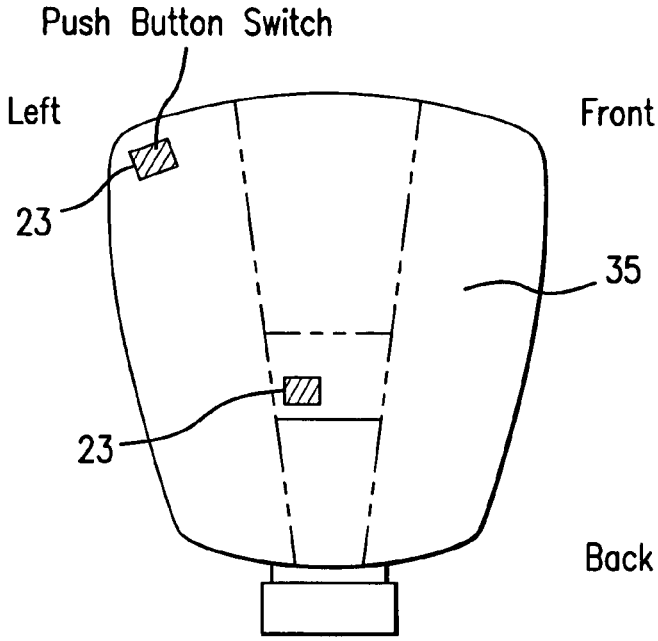
Figure 3:
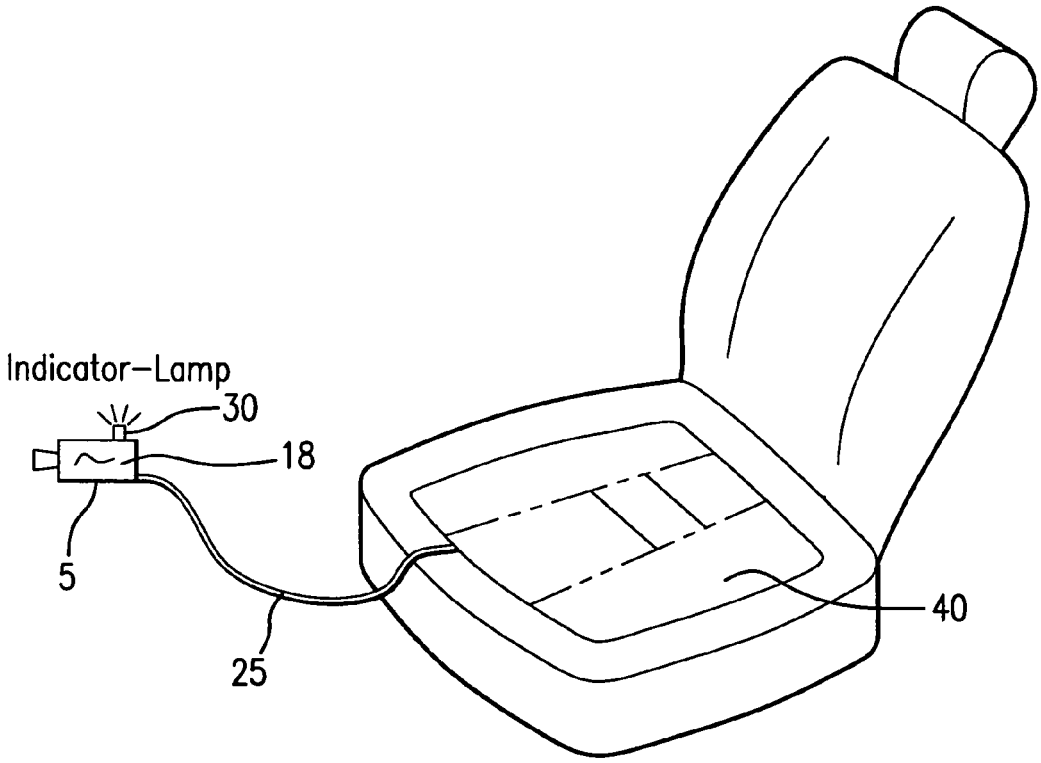

With additional reference to FIGS. 2–4, in a heated seat embodiment, the heating circuit (1) includes the power connector (5) for connection to the mating power source connector (10). The power connector (5) and the mating power source connector (10) are normally located external to the seating surface (35); however, this need not be the case as the power source connector may be extended into the seating surface for connection to the power connector (5).

The power connector (5) may be a cigarette lighter adaptor style plug connector (as shown in FIG. 3). The plug connector may house a fuse (18) providing over current protection. The heating indicator (30) may be incorporated within the body of the cigarette light adaptor style plug connector and may comprise a light emitting diode ("LED"). Other illuminating sources may serve as the heating indicator (30) and may be located in locations other than as part of the power connector (5).

The temperature control element (15), the heating element (20), and the power switch (23) are all located internal to the seat, within an occupant seating surface (35).

The layout of the heating element can vary depending upon application. For a seating area surface, as shown in FIG. 4, the heating element (20) is preferably laid out in a zig-zag configuration taking into account the portion of the occupant's body that will be heated. For a seating area, a preferred configuration of the heating element (20) is two longer portions (26) along two parallel sides where the occupant's upper legs will generally be placed, the two longer portions (26) being connected by a shorter portion (27) along a perpendicular side connecting the two longer portions where the occupant's posterior will generally be placed. The shorter portion (27) may have a greater width than either of the two longer portions (26).

The power switch (23) is positioned to be activated by pressure caused by the occupant's weight when the occupant sits on the seat. This position can include being proximate the occupant's posterior when sitting, one of the occupant's upper legs, or any other position as long as the occupant's weight creates sufficient pressure to activate the power switch (23). Two alternative locations are illustrated in FIG. 2.

Placing the power switch (23) proximate a leg position allows the occupant to conveniently shift her leg position to decrease the pressure felt by the power switch (23) and deactivate the heating circuit (1). This enhances safety as the occupant does not need to move her entire body to deactivate the heating circuit (1), allowing convenient and safe operation of both the heating circuit (1) and the vehicle.

The heating indicator (30) provides visual indication if the heating circuit (1) is operative and heating. This allows the occupant to know with certainty whether the heating circuit (1) is operative, thereby further enhancing safety.

Figure 5:
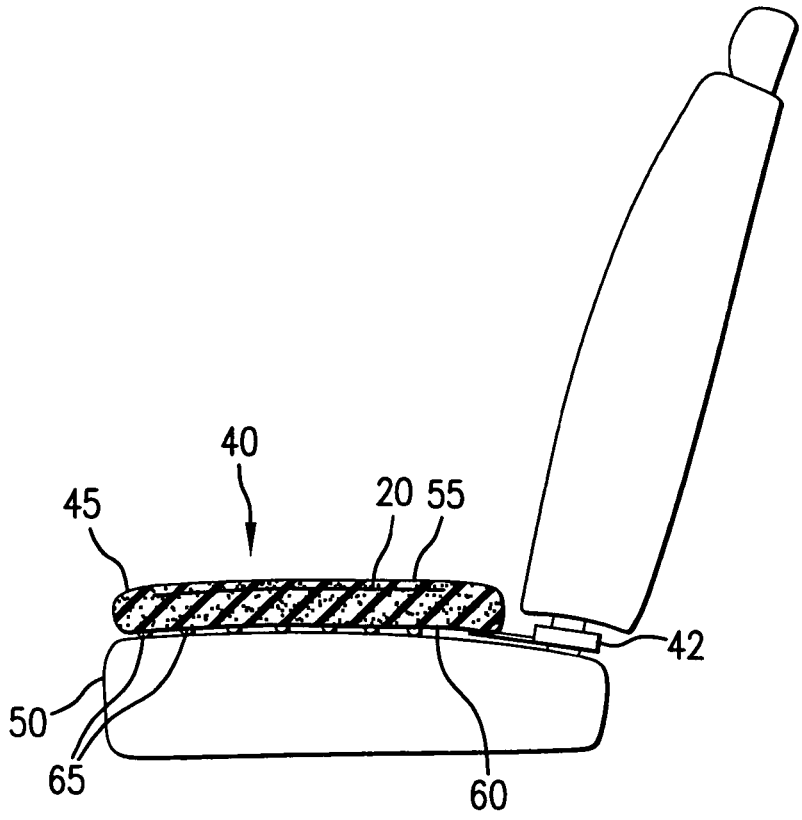
FIG. 5 is a sectional view of a portable heated vehicle seat cushion embodiment of the invention.

With reference to FIGS. 3 and 5, a portable heated vehicle cushion is in the form of a vehicle seat cushion (40). Such a form is both easy to transport and easy to position and use in any vehicle.

The seat cushion (40) includes cover (45) of a suitable material enclosing a resilient compressible core (50) of, e.g., foam and foam-like materials such as high density carpet padding. The core (50) and cover (45) are generally selected to conform to the shape of the body part that is in contact with the occupant so as to provide maximum comfort to the occupant.

As shown, the heating element, (20) is placed in an upper region of the core (50) adjacent the cover (45), or intermediate the core (50) and cover (45). The upper cover side (55), intended to be adjacent the occupant, is made of a material that readily transfers heat from the heating element to the occupant. The upper cover side (55) may be a suitable material such as upholstery fabrics, cloth fabrics, vinyl fabrics, and soft leather-like materials.

The positioning of the heating element (20) within the core, as well as the choice of materials, takes into account protecting the occupant sitting on the cushion from coming into direct contact with the heating element (20) and preventing exposure of the heating element (20) to the elements.

The lower cover side (60), intended to be adjacent the vehicle seating surface and away from the occupant, may be of the same or different material than the upper cover side (55). The lower cover side (60) may include insulating properties that help keep the heat generated by the heating element (20) within the cushion (40) and directed toward the occupant seating on the cushion (40), e.g., lined with reflective materials such as foil.

The lower cover side (60) is selected to be compatible with the vehicle seating surface. The lower cover side (60) is preferably made with a material that will prevent the cushion (40) from slipping while in use or is preferably given a non-slip treatment. This can be accomplished through material selection, e.g., using a rubber-like material, or through application of suitable non-slip elements (65) to the exterior of the lower cover side (60).

The non-slip elements (65) may be one or more protrusions or areas that would be slip-resistant against the vehicle seating surface. For vinyl vehicle seating surfaces, rubberized and rubber-like protrusions are suitable. Uniformly applying the lower cover side with rubberized dot protrusions is both attractive and effective as non-slip elements (65). For cloth vehicle seating surfaces, hook material that engages the cloth is effective such that the cloth acts as loop material and together, the hook material of the lower cover side (60) and the cloth act jointly as hook and loop material, e.g., as does VELCRO (trademark).

Figure 6:
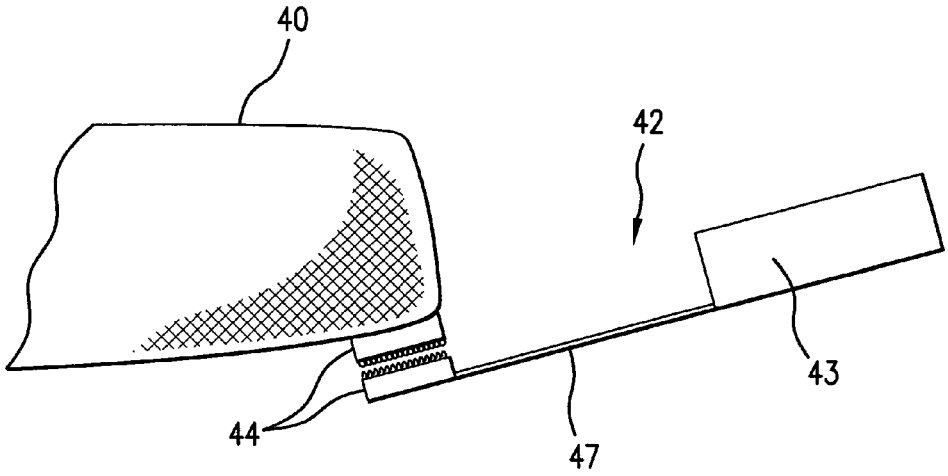
FIG. 6 illustrates an attachment device for utilizing with the invention.

Another attachment device (42) for securing the cushion (40) to a vehicle seat is illustrated in FIG. 5 and detailed in FIG. 6. This attachment device (42) comprises a restraining element (43), e.g., a compressible material (such as sponge or foam material), that is sized to be wedged between a seat base and a seat back as shown in FIG. 5 to provide a pressure fit.

The attachment device (42) with restraining element (43) is secured to the cushion (40) along a posterior edge. FIG. 6 shows one preferred arrangement using hook and loop tabs (44) removably securing the restraining element (43) via a tether (47). The tether may be made of fabric and may be a leaf-like member, optionally lined with hook and loop material.

As discussed above, the power switch (23) is positioned to be activated by pressure caused by the occupant's weight when the occupant sits on the seat cushion (40). Placing the power switch (23) proximate a leg position allows the occupant to conveniently shift her leg position to decrease the pressure felt by the power switch (23) and deactivate the heating circuit (1). This enhances safety as the occupant does not need to move her entire body to deactivate the heating circuit (1).

Figure 7:
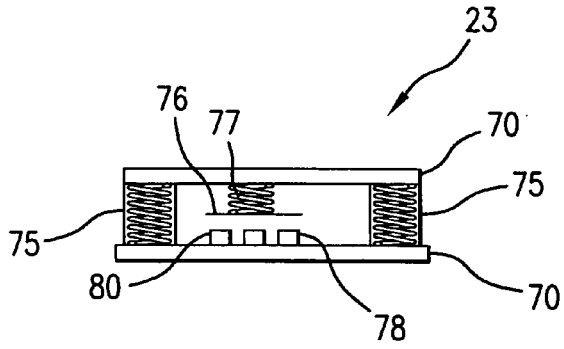
FIG. 7 illustrates one power switch suitable for use in the present invention.

With reference to FIG. 7, there is illustrated one pressure activated power switch (23) suitable for use in the present invention.

The illustrated power switch (23) comprises two plates (70) biased, by resilient members (75), to be normally separated. The top plate (70) has a metal contact (76) connected by another resilient member (77), preferably a coil spring. The bottom plate (70) has electrodes (78), the electrodes preferably printed onto the bottom plate (70) and separated from each other by a gap. The resilient members (75), absent pressure from the occupant, separate the plates from a space (80) therebetween.

Other configurations for the metal contact, coil spring and electrodes may be used, e.g., electrical wires soldered onto the plate may substitute for the electrodes.

The resilient members may be made of any suitable materials selected in consideration of numerous cycles subject to typical occupant weights. For example, sponge or springs may serve as resilient members (75).

The power switch may take other forms, including a single cylindrical resilient member that includes a hollow interior accommodating the electrode and the electrical contact to allow engagement therebetween.

The selected power switch operates, in a seat cushion application, responsive to the weight of the occupant pressing down the top plate (70), compressing the resilient members (75) so that the metal contact (76) of the top plate (70) engages with the electrodes (78) on the bottom plate (70) to eliminate the space (80) and allow power to the heating element (20). Once power is provided to the heating element (20), the heating indicator (30) illuminates.

When the occupant shifts her weight such that there is insufficient pressure to overcome the bias provided by the resilient members (75), the space (80) reappears and the heating circuit (1) is deactivated, the heating indicator (30) going dark.

Figure 8:
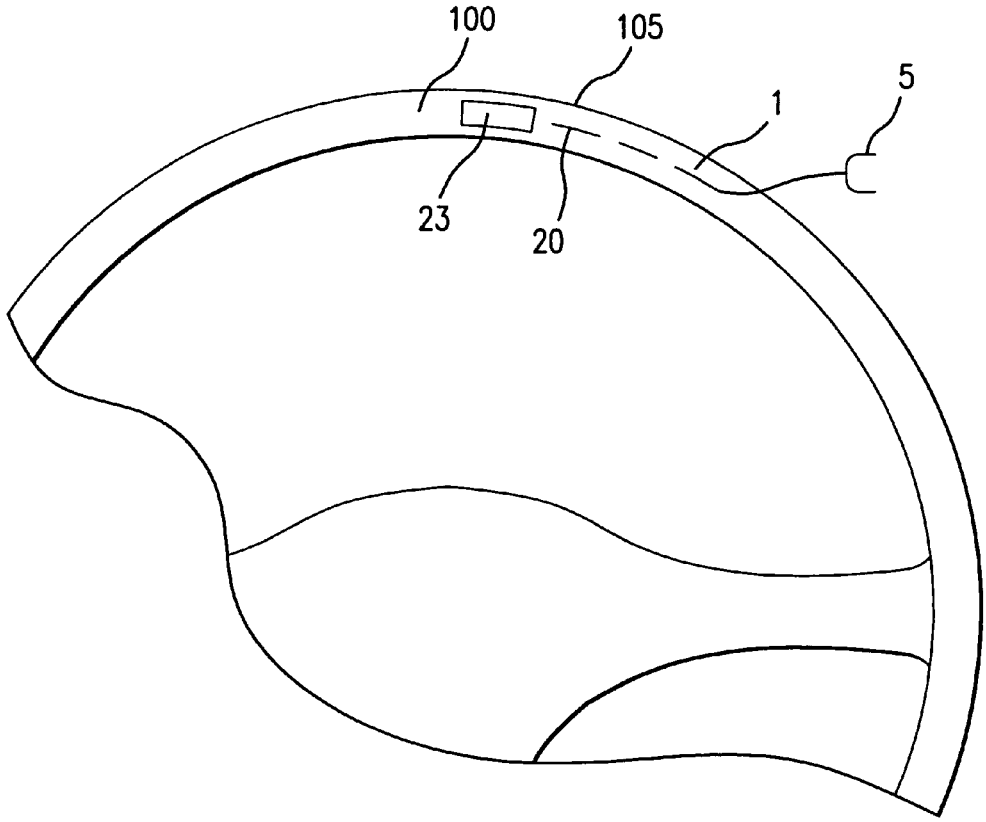
FIG. 8 shows a steering wheel cover embodiment of the invention.

With reference to FIG. 8, there is shown a steering wheel cover embodiment of the present invention.

The steering wheel cover (100) includes an external cushion covering (105) housing the inventive vehicle heating circuit (1) comprising the power connector (5) for connection to the mating power source connector (10), the temperature control element (15), the fuse (18), the heating element (20), the pressure activated power switch (23), power cabling (25), and the heating indicator (30).

This embodiment also may run off the vehicle's normal DC power provided via the power source connector (10). Due to the relatively limited power requirements, the heating circuit (1) may also be powered from an independent battery or battery pack (13).

The heating element (20) is preferably a flexible thermoresistive element that produces heat when electricity flows through it. The heating element (20) is selected with sufficient flexibility to withstand being placed on and removed from the steering wheel.

The power switch (23) is activated (closed) by pressure, e.g., from the occupant squeezing the steering wheel cover (100) at the location of the power switch (23). This ensures the heating circuit (1) is only active when desired.

Similar to the seat cushion embodiment, the driver is protected from heating element itself. The external cushion covering (105) is selected to readily transfer heat from the heating element (20) to the driver, while at the same time offering the driver a good gripping surface. The amount of cushioning provided by the covering (105) is as desired for a particular application.

The power switch (23) is positioned to be activated by pressure caused by the driver. A pressure switch as illustrated in FIG. 7 may be used. However, because a driver will change her hand position on the steering wheel, the power switch may alternatively be of the type that requires pressure to closed but does not open (deactivate) when pressure is released.

With reference to FIGS. 2–3 and 5 which show a pocket or pouch (90) that accommodates a conventional heat pack (95).

This arrangement allows the use of the portable cushion at locations remote from a vehicle and with or without battery packs. For example, if a battery pack is depleted, the heat pack (95) can be activated and placed in the pouch (90).

The portable embodiments of the invention are foldable and may be stored or moved in a convenient bag or package. The bag or package may also store a portable battery pack, the heat pack, and a power connector (5) disconnected from the remainder of the heating circuit (1). Folding may be accomplished readily due to the thin and flexible nature of the portable cushion. Also stitching lines 97 facilitate folding into thirds or other configurations.

The invention claimed is:

1. A portable heated vehicle cushion, comprising:

a cushion cover with an upper cover side and a lower cover side; and a heating circuit (1) located partly inside the cushion cover and partly outside the cushion cover, the heating circuit (1) comprising a heating element (20) located inside the cushion cover to generate heat when activated, a temperature control element (15) operatively connected to the heating element to cyclically control activation of the heating element based on temperature, the temperature control element being located inside the cushion cover, a pressure activated power switch (23) operatively connected to the temperature control element and the heating element to activate the heating circuit based on applied pressure, the power switch being located inside the cushion cover, a direct current power connector (5) for connection to a mating direct current power source connector (10), the power connector being located outside the cushion cover, and power cabling (25) connecting the heating element, the temperature control element, the pressure activated power switch, and the direct current power connector, wherein, the heating element includes a zig-zag configuration limited to a portion of the occupant's body that will be heated, the heating element comprises two longer portions along two parallel sides where the occupant's upper legs will generally be placed, the two longer portions being connected by shorter portions extending between and connecting the two longer portions where the occupant's posterior will generally be placed.

2. The portable heat vehicle cushion of claim 1, further comprising:

a padded core located intermediate the upper and lower cover sides; and a heating indicator (30) that illuminates when the heating element is active and generating heat, wherein, the heating circuit runs off vehicle battery power, the direct current power connector is a cigarette lighter style plug connector for connection to a mating cigarette lighter style plug receptacle, insufficient applied pressure on the pressure activated power switch deactivates the heating circuit, and the heating indicator is integral with the direct current power connector.

3. The portable heat vehicle cushion of claim 2, wherein, the heating element is located intermediate the upper cover side and the padded core, and the heating element is a thermo-resistive element that produces heat from applied electricity.

4. The portable heat vehicle cushion of claim 3, wherein, the heating element is flat, and the temperature control element is an user-adjustable thermostat.

5. The portable heat vehicle cushion of claim 3, wherein, the heating element has an essentially flat upper surface, and the temperature control element is an user-adjustable thermostat.

6. The portable heat vehicle cushion of claim 3, wherein, the heating element is essentially flat without transferring shape through the upper cover side, and the temperature control element is a variable element set to control the amount of electrical power provided to the heating element.

7. The portable heat vehicle cushion of claim 2, wherein, the padded core, the upper cover side, and the lower cover side are shaped as a portable vehicle seat cushion, a tethered restraining element connected to the cushion cover and made of resilient material sized for fitting between a seat base and a seat back, the power switch is positioned to be activated by a vehicle occupant's weight when sitting on a horizontal portion of the upper cover side, the padded core is of a resilient compressible material.

8. The portable heat vehicle cushion of claim 7, wherein, the power switch is positioned at a location corresponding to the occupant's upper leg when sitting on the horizontal portion of the upper cover side so that the power switch is activated by the occupant's upper leg when sitting on the horizontal portion of the upper cover side.

9. The portable heat vehicle cushion of claim 1, wherein, the direct current power connector for connection to a mating direct current power source connector is configured for connection to battery independent from a vehicle battery.

10. The portable heat vehicle cushion of claim 7, wherein, the pressure activated power switch comprises two plates biased to be normally separated by resilient members, a top one of the two plates having a metal contact and connected to one of the plates, a bottom one of the two plates having electrodes and connected to another of the plates, the resilient members, absent pressure from the occupant, separating the plates to form a space therebetween with the switch being in an open state.

11. A heated vehicle cushion, comprising:

a cushion cover with an upper cover side; and a heating circuit (1) located partly below the cushion cover and partly outside the cushion cover, the heating circuit (1) comprising a thermo-resistive heating element (20) that produces heat from applied electricity, the heating element located below the cushion cover to generate heat when activated, a thermostat (15) operatively connected to the heating element to control activation of the heating element based on temperature, the temperature control element being located below the cushion cover and proximate the heating element, a pressure activated power switch (23) operatively connected to the thermostat and the heating element to activate the heating circuit based on applied pressure, a direct current power connector (5) for connection to a mating direct current power source connector (10), the power connector being located outside the cushion cover, a heating indicator (30) that illuminates when the heating element is active and generating heat, and cabling (25) connecting the heating element, the temperature control element, the pressure activated power switch, and the direct current power connector, wherein, the heating circuit runs off vehicle battery power, the direct current power connector is a user-removable plug connector for connection to a mating plug receptacle, and the heating indicator is integral with the direct current power connector, wherein, the heating element includes a zig-zag configuration taking into account a portion of the occupant's body that will be heated, the heating element comprising two longer portions along two parallel sides where the occupant's upper legs will generally be placed, the two longer portions being connected by shorter portions extending between and connecting the two longer portions where the occupant's posterior will generally be placed with the remaining cushion areas being unheated, free of heating element portions.

12. The heated vehicle cushion of claim 11, wherein, the heating element is located intermediate the upper cover side and a padded core, the power switch is located under intermediate the padded core and the upper cover side, and insufficient applied pressure on the pressure activated power switch deactivates the heating circuit.

13. The heated vehicle cushion of claim 12, wherein, the padded core and the upper cover side are shaped as a portable vehicle seat cushion, the power switch is positioned to be activated by a vehicle occupant's weight when sitting on a horizontal portion of the upper cover side, the padded core is of a resilient compressible material.

14. The heat vehicle cushion of claim 11, further comprising:

a heating pack pouch located intermediate the upper cover side and a padded core; and stitching lines located to facilitate folding of the cushion cover into at least three sections, wherein, the power switch is located under intermediate the padded core and the upper cover side, wherein, the power switch is activated by a first pressure from the occupant and is deactivated by subsequent reduced pressure from the occupant.

15. A vehicle heating system, comprising:

a direct current heating circuit for producing heat when activated;

a surface material covering the heating circuit to isolate the heating circuit from direct contact by a vehicle occupant or object resting against the surface material; and a pressure switch located below the surface material, proximate and connected to the heating circuit to activate the heating circuit during application of sufficient pressure on the pressure switch via pressure applied at a location proximate the pressure switch, insufficient pressure being applied to the pressure switch deactivating, wherein, the heating circuit the heating element includes a zig-zag configuration taking into account a portion of the occupant's body that will be heated, the heating element comprises two longer portions along two parallel sides where the occupant's upper legs will generally be placed, the two longer portions being connected by shorter portions along a perpendicular side connecting the two longer portions where the occupant's posterior will generally be placed.

* * * * *